US006401367B2

(12) United States Patent
Lancon

(10) Patent No.: US 6,401,367 B2
(45) Date of Patent: Jun. 11, 2002

(54) LOAD-BEARING APPARATUS HAVING SHOVEL

(75) Inventor: Bruno Lancon, Villy le Pelloux (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/769,457

(22) Filed: Jan. 26, 2001

(30) Foreign Application Priority Data

Jan. 28, 2000 (FR) ..... 0001267

(51) Int. Cl.[7] ..... A43B 5/00

(52) U.S. Cl. ..... 36/124; 36/122; 36/115; 36/59 R

(58) Field of Search ..... 36/115, 116, 122, 36/123, 124, 125, 1 R, 25 R, 142, 143, 144, 59 R

(56) References Cited

U.S. PATENT DOCUMENTS 3,269,037 A * 8/1966 Massicotte
3,600,829 A * 8/1971 La Violette
3,747,236 A * 7/1973 Sidlauskas
4,004,355 A * 1/1977 Koblick ..... 36/122
4,677,765 A * 7/1987 Lubet et al. ..... 36/116
4,826,183 A * 5/1989 Bratland et al. ..... 36/115
4,835,885 A * 6/1989 Hoshizaki et al. ..... 36/115

FOREIGN PATENT DOCUMENTS

FR 2760374 9/1998
FR 2771301 5/1999

* cited by examiner

*Primary Examiner*—M. D. Patterson
(74) *Attorney, Agent, or Firm*—Greenblum & Bernstein, P.L.C.

(57) ABSTRACT

A load-bearing apparatus including a raised front portion, the so-called shovel, that maintains the direction of the apparatus while allowing gliding. The lower surface of the shovel includes a protuberance that is oriented substantially along a longitudinal axis. The protuberance is connected to one of the edges of the shovel by a gliding surface that has a substantially continuous slope.

27 Claims, 4 Drawing Sheets

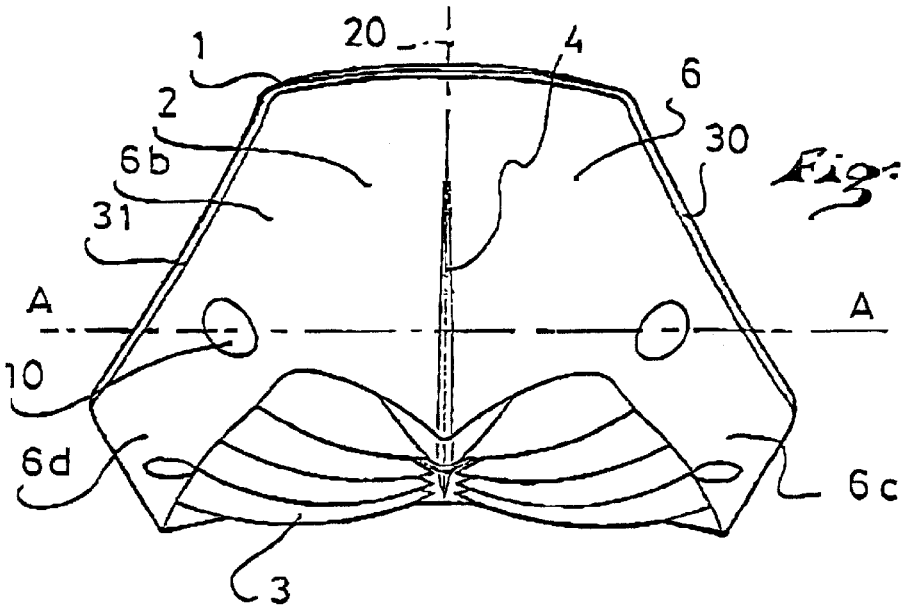
Fig. 2
Fig. 3
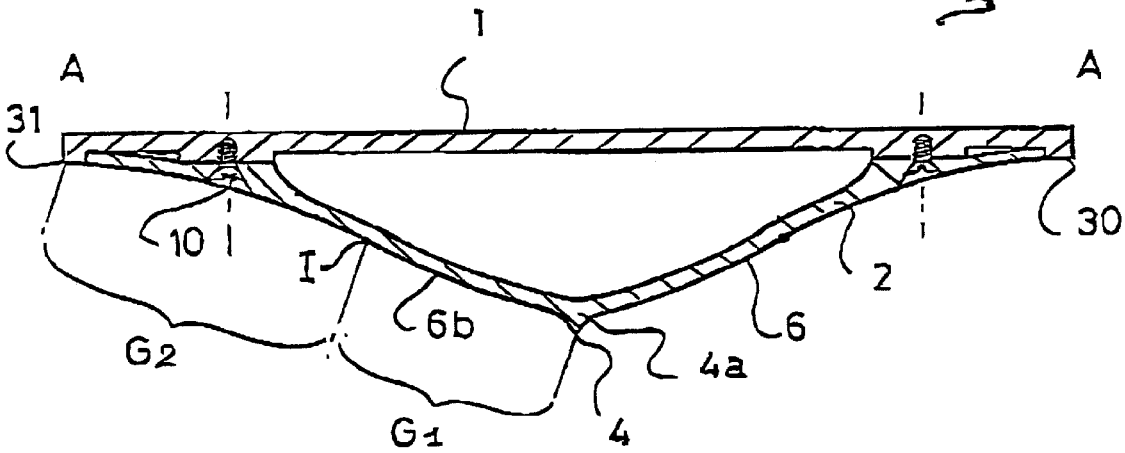

FIG. 5
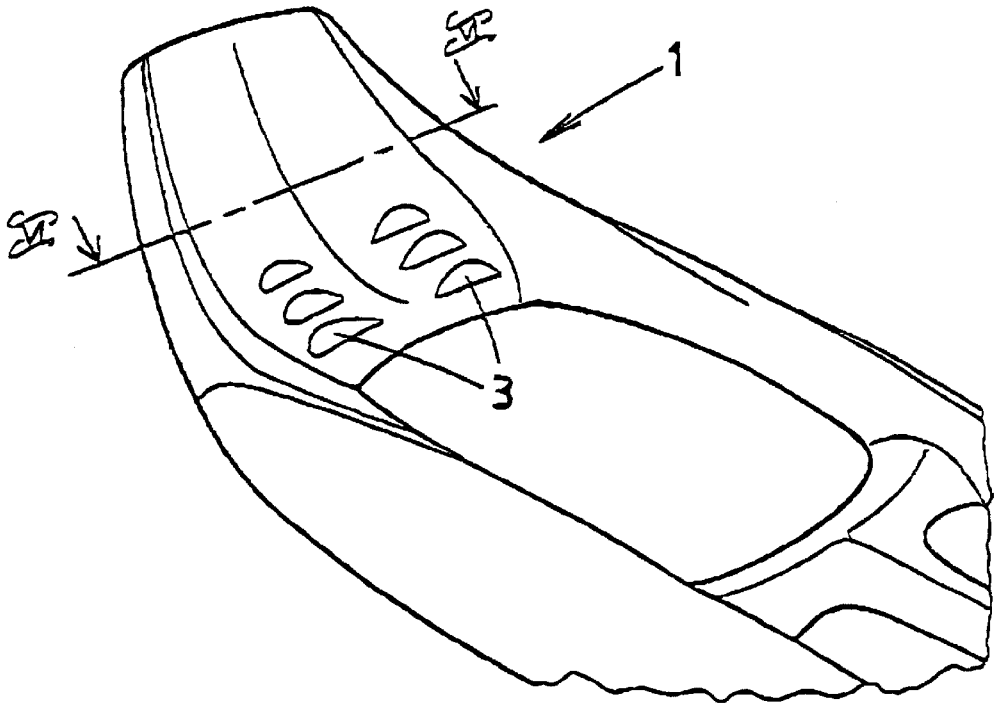
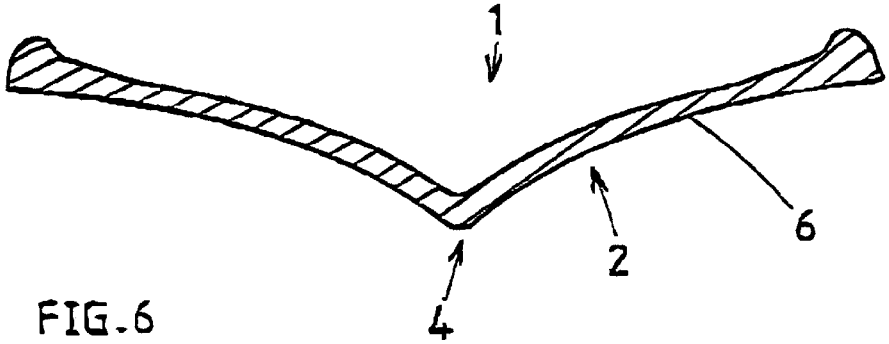
FIG. 6

LOAD-BEARING APPARATUS HAVING SHOVEL

BACKGROUND OF THE INVENTION

1. Field of the Invention

The present invention relates to a load-bearing apparatus adapted to be fixed to the user's foot and making it possible to increase the foot load-bearing capacity on a soft support such as snow, sand, or water. More particularly, the invention relates to the raised front portion, so-called shovel, of such a load-bearing apparatus.

2. Description of Background and Relevant Information

In the state of the prior art, the load-bearing apparatuses, such as snowshoes, have front ends, or shovels, that are more or less raised so as to facilitate the maneuver of pulling the snowshoe out of the snow during walking. The shovel follows a plane that is progressively incurved upward. However, these shovels are not designed specifically for walking, but are drawn from the shovels of apparatuses such as skis or snowboards. Such a shovel is used to engage a turn, therefore to pivot, and does not maintain the direction of the snowshoe during walking.

Another snowshoe, described in the document FR 2 760 374, includes a removable tip. This tip remains in the prior art, as previously described, and is provided with stiffening ribs projecting beneath the tip. These stiffening ribs, even if they are positioned in the axis of the apparatus, are not designed to improve the gliding. Indeed, they are connected to the tip by lateral edges that form, together with the tip, non-progressive junctions that are possibly reinforced with outer small transverse ribs, as shown in the drawings of the aforementioned document.

SUMMARY OF THE INVENTION

One of the objects of the present invention is to provide a load-bearing apparatus whose shovel holds the direction of the apparatus while preserving proper gliding so as to facilitate the release of the apparatus from the soft support during the walking movement of the user.

Another object of the invention is to provide an apparatus whose shovel ensures a non-return gripping function while improving the load-bearing capacity of the apparatus.

To achieve these objects, the load-bearing apparatus of the invention has a shovel that includes a protuberance fixed beneath the lower surface of the shovel, and oriented substantially along the longitudinal axis of the apparatus. Moreover, the protuberance is positioned forwardly with respect to the edges of the lower surface of the shovel by forming a sort of bow. This protuberance enables the apparatus, when it is in support on the shovel, to stabilize the direction of its movement along the longitudinal axis of the apparatus. The improved gliding of the shovel is obtained by gliding surfaces that connect the protuberance to the edges of the shovel. Furthermore, each gliding surface has a continuous slope. One can associate this shovel with scales that have a rearwardly directed concavity adapted to retain the apparatus on the soft support and against rearward movement.

BRIEF DESCRIPTION OF DRAWINGS

The invention will be better understood and other advantages thereof will become apparent from the description, with reference to the annexed drawings that are an integral part thereof. The description shows, by way of non-limiting examples, certain preferred embodiments, whereby:

FIG. 2 schematically shows a front view of the shovel.

FIG. 3 shows a transverse cross-sectional view of the shovel, taken along lines A—A of FIGS. 2 and 4.

FIG. 5 is a perspective view of the shovel according to a second embodiment.

FIG. 6 is a cross-sectional view taken along the line VI—VI of FIG. 5.

DETAILED DESCRIPTION OF THE INVENTION

Figure 1:
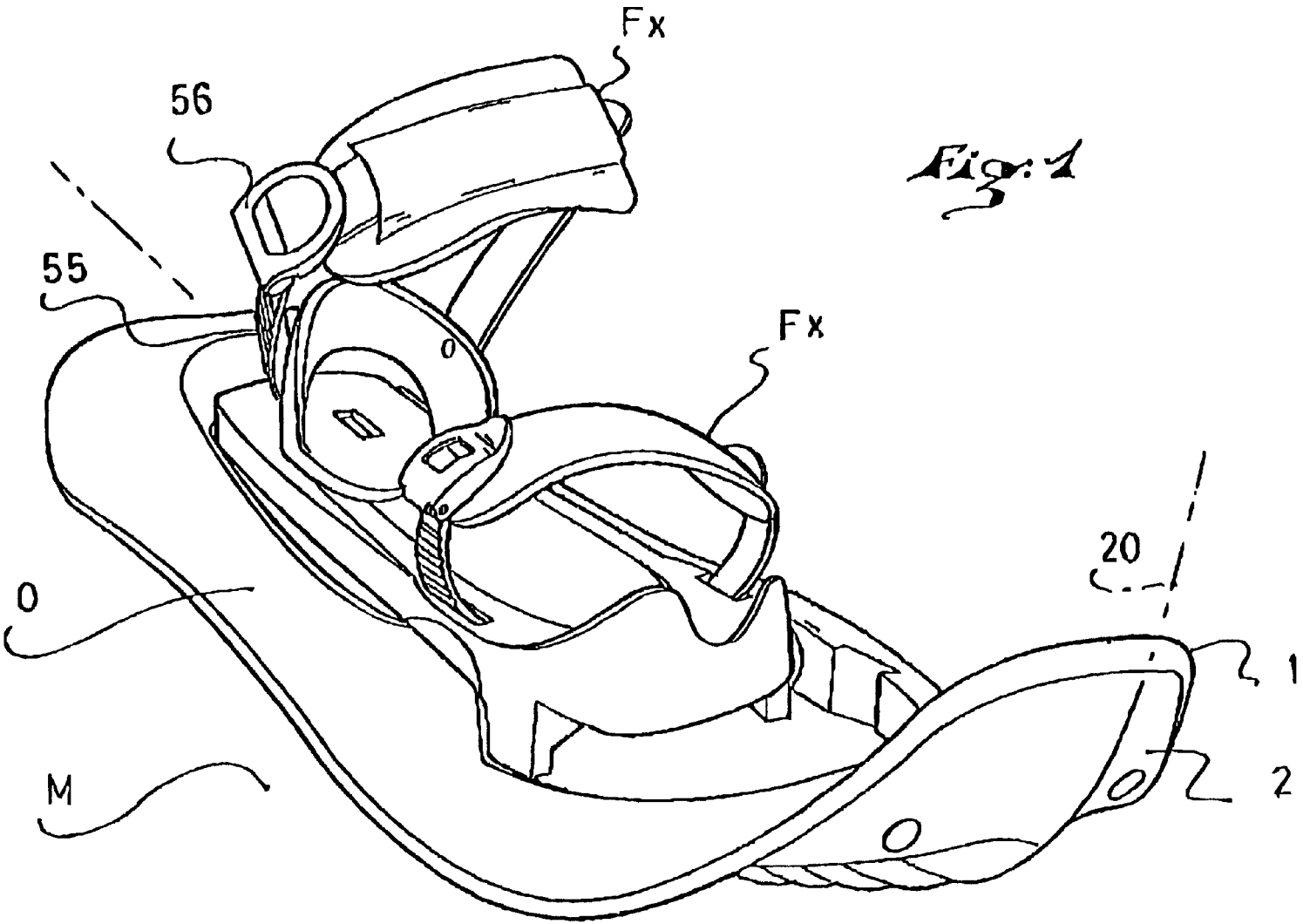
FIG. 1 shows a three-quarter front view of the load-bearing apparatus/shovel assembly.

FIG. 1 shows a general plane of the load-bearing apparatus that is constituted of a frame 0 on which the user's foot is fixed by members Fx, such as, for example, notched straps 55 provided with tightening buckles 56. These fixing members Fx can be journalled on the frame 0 or can be fixed against movement with respect thereto.

The frame 0, due to its surface that is greater than that of the foot, makes it possible to increase the user's foot load-bearing capacity on a soft support M, such as snow, sand, or water, i.e., a support that does not have enough load-bearing capacity to support the user without collapsing. The frame 0 generally includes an upper side, on which the fixing members Fx secure the foot thereto, and a lower side, facing soft support M. Further, the frame 0 has a raised front portion, i.e., a so-called shovel or shovel portion 1, forward of a boot supporting portion of the frame and extending along a longitudinal axis 20, the lower surface 2 of the frame being the object of the following description.

In FIG. 2, the shovel 1 is shown in a front view. The lower surface 2 of the shovel 1 includes a protuberance 4 oriented substantially along the longitudinal axis 20 of the load-bearing apparatus. The protuberance 4 is positioned forwardly with respect to the lateral edges 30, 31 of the lower surface 2 of the shovel 1. As shown in the side view of FIG. 4 in particular, the protuberance 4 is connected to one of the lateral edges 30, 31, by a gliding surface 6, 6*b*. To improve the gliding of the shovel 1, the gliding surface 6, 6*b* has a substantially continuous slope. The sloped surface designates a substantially continuous surface whose slope extends in a substantially continuous manner. This means that the surface does not have a very incurved zone, having either a small radius of curvature, or a point where a pronounced break in the slope is located.

The protuberance 4 can have a projecting ridge 4*a* for emphasizing the bow effect, and the edges 30, 31, can have very incurved zones so as to obtain a homogenous junction with the frame 0.

Figure 4:
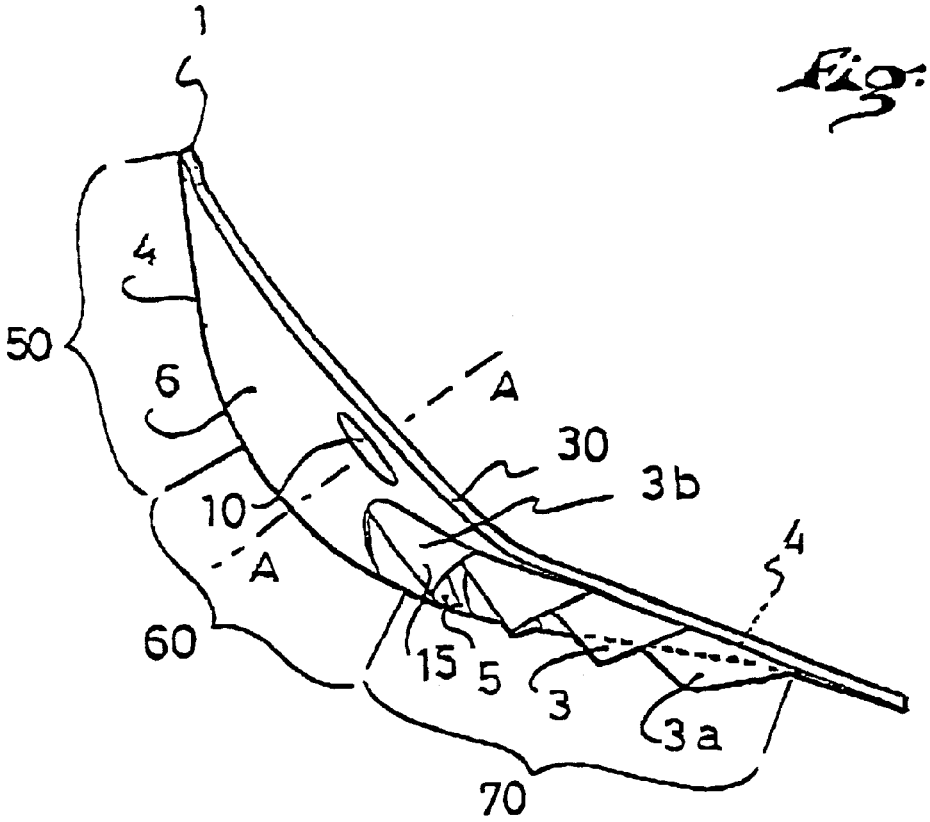
FIG. 4 schematically shows a side view of the shovel.

In the preferred embodiment, shown in FIGS. 2, 3, and 4, the lower wall or surface 2 of the shovel 1 has only one protuberance 4 positioned on the median axis of the frame 0 of the load-bearing apparatus. Two lateral gliding surfaces 6, 6*b* extending laterally around this protuberance 4 join the edges 30 and 31, respectively, of the shovel 1. The protuberance 4 associated with the gliding surfaces 6, 6*b*, makes it possible to pull the load-bearing apparatus out of snow or sand more easily during the striding movement of the user. Moreover, the protuberance 4 procures a directional effect on the gliding that reinforces the kinematics of the movement of the user's leg during walking. This association of means makes it possible to bias the joints of the ankles, knees and hips of the user against undesirable lateral or rotational movement. Thus, it protects the aforementioned joints from possible strains.

A plurality of protuberances 4, projecting on the lower surface of the lower surface 2 of the shovel 1, can be arranged substantially symmetrical with respect to the median axis of the load-bearing apparatus. The two protuberances located outside the shovel are connected to the edges 30, 31, by gliding surfaces consistent with the above description. The protuberances are also connected to one another by gliding surfaces that have a continuous slope.

Furthermore, one can advantageously associate the previously described arrangement with at least one scale 3, arranged on the lower surface of wall 2 of the shovel 1, which ensures a function of retaining the gliding apparatus toward the rear. In the preferred embodiment, shown in FIG. 1, the scales 3 are substantially symmetrical with respect to the longitudinal axis 20, and are surrounded by a gliding surface 6*c*, 6*d* at the level of the lateral edges 30 and 31, respectively. The gliding surfaces 6*c* and 6*d* are here constituted by a downward extension of the gliding surfaces 6 and 6*b*.

FIG. 3 shows the transverse cross-section A—A, positioned in FIGS. 2 and 4, in a plane perpendicular to the shovel 1 of the load-bearing apparatus. This figure shows an embodiment in which the lower surface 2 is constituted by an independent piece, or wall, that is fixed on the shovel 1 by appropriate attachment elements, such as screws 10. Alternatively, the lower wall could also be made as an integral part of the shovel, such as a single-piece structure. This figure specifies the preferred geometry for the gliding surfaces 6 and 6*b*. The description that follows only relates to the gliding surface 6*b*, but it can be applied advantageously to the gliding surface 6, especially by symmetry with respect to the protuberance 4.

The gliding surface 6*b* includes two distinct zones G1 and G2, separated by a point of inflexion I. In the first zone G1, which is demarcated by the protuberance 4, the gliding surface 6*b* defines a convex curve in the transverse direction, i.e., it has a tendency to form a boss projecting on the bottom of the load-bearing apparatus. In the second zone G2, which is demarcated by the edge 31, the gliding surface 6 defines a concave curve, i.e., it has a tendency to form a recess. This constructional arrangement makes it possible to associate the load-bearing of the concave portion on the edges 30, 31 and the gliding of the convex portion around the protuberance 4. Gliding surfaces 6, 6*b* are contemplated that are simply convex or concave, therefore without a point of inflexion, depending upon whether one prefers gliding or load-bearing.

FIG. 4 makes it possible to specify, due to its side view, the position of the scales 3 in the longitudinal direction with respect to the gliding surface 6. The protuberance 4 includes three distinct zones. A raised zone 50 located at the front end of the shovel 1, and extending almost vertically, a slightly raised zone 70 that extends the load-bearing capacity of the frame 0, and a transition zone 60 that has a strong curvature and is located between the raised zone 50 and the slightly raised zone 70.

To obtain the best compromise between gliding and gripping, the gliding surface is positioned on the raised zone 50 as well as on the transition zone 60, and the scales 3, 3*a*, 3*b*, are positioned on the slightly raised zone 70. Thus, when the load-bearing apparatus advances in the snow, the zones 50, 60, glide on the snow and the strong inclination of these two zones 50, 60 transforms the horizontal thrust into a vertical thrust that helps in pulling the apparatus out of the snow. Moreover, when the foot is in the impulse phase on the load-bearing apparatus, the scales 3, 3*a*, 3*b*, that are positioned on the slightly raised zone 70 are in contact with the snow and, due to their concavity 5, can ensure a rearward retaining of the apparatus.

In the preferred embodiment, the scales 3, 3*a*, 3*b*, are arranged rearward of the gliding surface 6, 6*b*. The scales 3, 3*a*, 3*b*, also have a gliding zone 15 located in front of the retaining concavity 5, and which has a downward and rearward inclination. Moreover, the scales 3*b* that are located in the vicinity of the transition zone 60 are set back with respect to the protuberance 4, whereas the scales 3*a*, which are opposite, are arranged so as to project with respect to the protuberance 4. That is, as seen in FIG. 4, the scales 3*a* project downwardly beyond the protuberance 4 and the scales 3*b* have at least a portion that extends downwardly no further than the protuberance. This observance of such a constructional arrangement ensures a good progressiveness between the gliding function on the front of the shovel 1, and the retaining function on the rear thereof.

The scales 3, 3*a*, 3*b* could have different geometries consistent with the existing state of the art of retaining scales. They could also be replaced by other retaining means, especially skins.

Moreover, the shovel can also be constituted advantageously of a shell made of plastic that uses the geometry of the lower surface 2, such that the shell is connected to the frame 0 in a non-removable manner, or is directly integrated into the frame 0, such as being made unitary therewith.

Such an embodiment is shown, as an example, in FIGS. 5 and 6, where the shovel 1 is completely integrated therewith, having been molded with the frame 0 of the snowshoe.

This avoids the double wall construction of the shovel 1 of the preceding embodiment, i.e., the upper wall and the lower wall, and, therefore, substantially lightens the snowshoe.

Furthermore, in the embodiment of FIGS. 5 and 6, the shovel is substantially identical to that of FIGS. 1–4, and the same elements are therefore specified by the same references. In this case, the scales 3 are recessed within and project downwardly from the upper surface of the shovel 1.

The lower wall 2 of the shovel 1 and/or the frame 0 can be made of polypropylene or polyamide, for example, or of other thermo-injected plastic materials. The load-bearing element thus obtained can be used, and in a non-limiting example, as a snowshoe, sandshow, wake board, water ski, etc., i.e., in any soft environment lacking sufficient load-bearing capacity to sustain the user's weight.

The present invention is not limited to the embodiments described hereinabove, which are provided for guidance only, but encompasses all similar or equivalent embodiments.

The instant application is based upon French Patent Application No. 00.01267, filed Jan. 28, 2000, the disclosure of which is hereby incorporated by reference thereto in its entirety, and the priority of which is hereby claimed under 35 U.S.C. §119.

What is claimed is:

1. A load-bearing apparatus adapted to be fixed to a user's foot and adapted to increase a foot load-bearing capacity on a soft support, especially snow, sand, or water, said apparatus comprising:

a frame having a raised front shovel portion, said raised front shovel portion having edges and a lower surface adapted to come in contact with the soft support, the frame extending along a longitudinal axis;

said raised front shovel portion comprising a lower surface having at least one protuberance, said protuberance being oriented substantially along the longitudinal axis, and said raised front shovel portion including at least one gliding surface, said gliding surface having a substantially continuous slope and connecting said protuberance to one of said edges of said lower surface of said raised front shovel portion, said raised shovel portion including at least one scale arranged on said lower surface, said at least one scale having a rearwardly directed concavity adapted to retain the apparatus on the soft support and against rearward movement.

2. A load-bearing apparatus according to claim 1, wherein said protuberance is positioned on a median axis of the apparatus.

3. A load-bearing apparatus according to claim 1, wherein said at least one protuberance is substantially symmetrical about a median axis of the apparatus, and wherein said at least one protuberance is connected by a gliding surface having a continuous slope.

4. A load-bearing apparatus according to claim 1, wherein said protuberance includes three distinct zones, said three distinct zones comprising a raised zone located at a front end of the raised front shovel portion, a slightly raised zone, and a curved transition zone positioned between said raised zone and said slightly raised zone.

5. A load-bearing apparatus according to claim 4, wherein said at least one scale is located on said slightly raised zone.

6. A load-bearing apparatus according to claim 4, wherein said at least one scale is located in the vicinity of said transition zone.

7. A load-bearing apparatus according to claim 4, wherein said at least one scale is located on said slightly raised zone and in the vicinity of said transition zone.

8. A load-bearing apparatus according to claim 1, wherein each said scale is arranged behind said gliding surface.

9. A load-bearing apparatus according to claim 1, wherein each said scale is arranged in an area of said slightly raised zone.

10. A load-bearing apparatus according to claim 1, wherein said scales are substantially symmetrical along the longitudinal axis.

11. A load-bearing apparatus according to claim 4, wherein at least one gliding surface is positioned on one of opposite sides of said protuberance in an area of one of said zones.

12. A load-bearing apparatus according to claim 1, wherein said gliding surface surrounds said scale, in an area of an edge of said lower surface of said raised front shovel portion.

13. A load-bearing apparatus according to claim 1, wherein at least one of said scales is arranged so as to project downwardly with respect to said protuberance.

14. A load-bearing apparatus according to claim 1, wherein said raised front shovel portion has a lower portion, said lower portion of said raised front shovel portion being part of a piece attached on said raised front shovel portion by attachment elements.

15. A load-bearing apparatus adapted to be fixed to a user's foot to increase a load-bearing capacity on a soft support, said apparatus comprising:

a longitudinally extending frame having an upper side adapted to support a user's foot and a lower side adapted to contact the soft support, said frame further having a forwardly and longitudinally extending raised front end portion, said forwardly and longitudinally extending raised front end portion constituting a shovel, said shovel extending longitudinally between laterally opposite sides of said frame and including a portion of said lower side of said frame for contacting the soft support;

said portion of said lower side of said frame comprised by said shovel having at least one scale, said at least one scale having a rearwardly directed concavity to retain the apparatus on the soft support against rearward movement.

16. A load-bearing apparatus according to claim 15, wherein said portion of said lower side of said frame comprised by said shovel includes a substantially longitudinally extending protuberance, said protuberance extending forwardly substantially to a forwardmost extent of said frame, said portion of said lower side of said frame for contacting the soft support comprising at least one gliding surface, said gliding surface having a substantially continuous slope and connecting said protuberance to one of said opposite sides said frame.

17. A load-bearing apparatus according to claim 16, wherein said protuberance is positioned along a median axis of the apparatus.

18. A load-bearing apparatus according to claim 17, wherein said at least one scale comprises a plurality of longitudinally spaced scales.

19. A load-bearing apparatus according to claim 16, wherein said protuberance is substantially symmetrical about a median axis of the apparatus, and wherein said protuberance is connected by a gliding surface having a continuous slope.

20. A load-bearing apparatus according to claim 15, wherein said portion of said lower side of said frame for contacting the soft support comprises at least one gliding surface, said gliding surface surrounding said at least one scale on opposite lateral sides of said at least one scale.

21. A load-bearing apparatus according to claim 15, wherein said portion of said lower side of said frame comprised by said shovel includes three distinct, longitudinally successive zones, said three zones including a raised zone located at a front end of said shovel, a slightly raised zone, and a transition zone positioned between said raised zone and said slightly raised zone.

22. A load-bearing apparatus according to claim 21, wherein said at least one scale is located in said slightly raised zone.

23. A load-bearing apparatus according to claim 21, wherein said at least one scale is located in said transition zone.

24. A load-bearing apparatus according to claim 21, wherein said at least one scale comprises a plurality of scales, said plurality of scales being located in said slightly raised zone and in said transition zone.

25. A load-bearing apparatus according to claim 15, wherein said portion of said lower side of said frame comprised by said shovel includes a substantially longitudinally extending protuberance, wherein said at least one scale comprises a plurality of longitudinally spaced scales, at least one of said scales projecting downwardly beyond said protuberance and at least a second of said scales having at least a portion extending downwardly no further than said protuberance.

26. A load-bearing apparatus according to claim 25, wherein said at least one scale is positioned laterally of said protuberance.

27. A load-bearing apparatus according to claim 15, wherein said frame includes a boot-supporting portion rearward of said shovel, and wherein said at least one scale is entirely forward of said boot-supporting portion.

* * * * *